United States Patent [19]

Deussner et al.

[11] 4,428,727

[45] Jan. 31, 1984

[54] BURNER FOR SOLID FUELS

[75] Inventors: Herbert Deussner, Bergisch Gladbach; Horst Herchenbach, Hennef/Sieg Heisterschoss; Hubert Ramesohl, Bergisch Gladbach; Wolfgang Breidenstein, Bergisch Gladbach, all of Fed. Rep. of Germany

[73] Assignee: Klöckner-Humboldt-Deutz AG, Fed. Rep. of Germany

[21] Appl. No.: 284,986

[22] Filed: Jul. 20, 1981

[30] Foreign Application Priority Data

Jul. 21, 1980 [DE] Fed. Rep. of Germany ..... 3027587

[51] Int. Cl.[3] ..... F23D 1/00

[52] U.S. Cl. ..... 431/182; 431/187; 431/284; 110/261; 110/263; 239/424

[58] Field of Search ..... 431/182, 183, 187, 284, 431/350, 351; 110/261-265; 239/403, 404, 406, 239/423, 424, 601

[56] References Cited

U.S. PATENT DOCUMENTS 3,669,628 6/1972 Latham, Jr. et al. ..... 239/424

FOREIGN PATENT DOCUMENTS 1052046 3/1959 Fed. Rep. of Germany ..... 110/261
1118917 12/1961 Fed. Rep. of Germany ..... 239/424
1551807 1/1970 Fed. Rep. of Germany ..... 239/424
2905746 8/1980 Fed. Rep. of Germany ..... 110/262
54-140230 10/1979 Japan ..... 110/263

OTHER PUBLICATIONS

Periodical "Zement-Kalk-Gips", vol. 32, (1979), No. 8, pp. 386-389.

*Primary Examiner*—Lee E. Barrett
*Attorney, Agent, or Firm*—Hill, Van Santen, Steadman & Simpson

[57] ABSTRACT

A burner for introducing a suspension of solid fuel particles into a combustion chamber which includes a tubular conduit arranged to receive the suspension therethrough, and flow diverting means positioned at the discharge end of the conduit, and subdividing the cross section of the discharge end into a plurality of discharge openings. The burner may include a centrally disposed conduit which is coaxial with and surrounded by the tubular conduit, and an outer conduit surrounding the tubular conduit and coaxial therewith. The flow diverting means can be positioned at various positions between the respective conduits, to create a turbulent suspension of particles in the primary air stream, creating an aspirating effect for drawing secondary air into the burner along with the turbulent suspension of solid fuel particles.

2 Claims, 8 Drawing Figures

BURNER FOR SOLID FUELS

BACKGROUND OF THE INVENTION

1. Field of the Invention

This invention is in the field of burners for introducing a suspension of solid fuel particles into a combustion chamber such as a rotary kiln. It provides an arrangement of concentric conduits which create substantial turbulence in the particle suspension and combine it with a secondary air source to provide efficient combustion in the combustion chamber.

2. Description of the Prior Art

The present invention is particularly applicable to providing a burner assembly for the introduction of solid fuels into a rotary tubular kiln. In such rotary kiln burners, the air necessary for combustion is partly derived from the air stream which conveys the fuel particles into the chamber and is partly composed of hot exhaust air. This air source is called primary air. A source of secondary air is combined with the primary air, the secondary air being derived from a cooler following the rotary tubular kiln. Typically, such secondary air has a temperature of 800° C. or more so that this secondary air cannot be employed for the transport of the solid fuel, particularly coal dust, for reasons of safety. For reasons of thermal economy, the proportion of primary air must be kept as small as possible.

Rotary kiln burners for coal dust are described in the periodical "Zement-Kalk-Gips" (Vol. 32 (1979) No. 8, pages 386–389) with particular reference to FIG. 4, which illustrates a burner in which a number of tubes are disposed coaxially, one inside the other, whereby a mixture consisting of primary air and coal dust leaving the burner axially or with a slight divergence is surrounded at both sides in a radial direction by a stream of clean air. The inside air stream, as seen in the radial direction, emerges from the burner with an arcuate flow pattern, and the outer air stream emerges from the burner by means of axial bodies or with a slight divergence. The shape of the flame is controlled by controlling the outer and/or the inner air stream independently of the discharge rate of the mixed stream which is largely determined by the primary air stream.

In achieving a complete and rapid combustion, however, the problem of securing an intimate admixture of the mixed stream consisting of primary air and solid fuel emerging from the burner on the one hand with the hot secondary air on the other hand arises. Fundamentally, this can be achieved by means of providing a sufficient turbulence at the emerging mixed stream. However, there are difficulties in accomplishing this condition. There are limits on the amount of increase of discharge rate of the mixture, since a flame in the rotary tubular kiln which is too long has a considerably disruptive effect on the pyrometric process, particularly on the location of the sintering zone and the calcining zone of the rotary tubular kiln. The lower limit of discharge rate is dependent on the conditions under which the powdered material is conveyed into the rotary kiln. There is an urgent need for varying the amount of fuel introduced into the rotary kiln and thus, the amount of heat, since there are considerable fluctuations with respect to calorific content and other parameters influencing the combustion process in the use of solid fuels in contrast to liquid or gaseous fuels. It is, therefore, necessary to introduce variable amounts of fuel into the rotary tubular kiln and at the same time maintain the conditions for a thorough intermixing of the mixture and secondary air to such a degree that the flame which occurs remains short, concentrated and hot.

The use of a spiraling or helical motion in the emerging coal dust-air mixture has been considered in order to be able to better mix the fuel with the secondary air in the rotary kiln. This, however, is not satisfactory because the coarser coal dust particles have too short a flight path and strike the material to be roasted or the wall of the kiln in a state of incomplete combustion.

SUMMARY OF THE INVENTION

The present invention seeks to improve the intermixture of a mixed stream containing primary air and solid fuel particles with hot secondary air to thereby introduce the hot secondary air into the core of the fuel-air mixture as directly as possible in front of the discharge outlets of the burner. The objective is achieved by modifying the flow cross section of the tubular guide member forming the passageway for the fuel-air mixture, and at least one other tube which extends essentially parallel to the tubular guide member and terminates in a plurality of discharge outlets on the combustion side. The burner structure of the present invention results in a flow distribution such that the surface which can accept hot secondary air is substantially enlarged in comparison to burner designs in which only a mixed stream is discharged. Due to the reduction of cross section in the area of the discharge outlet, a higher velocity is achieved in comparison to conventional burner structures, so that turbulence occurs and the conditions for thorough intermixing are substantially improved. A considerable acceleration of the mixture with hot secondary air is obtained, and a considerable acceleration of the combustion process is likewise obtained. Consequently, the short and hot flame which is desired for the roasting operation can be conveniently obtained. A further advantage resides in the fact that the hot secondary air arrives in the center of the flame.

One embodiment of the present invention provides a tubular conduit in which the flow cross section is interrupted by a plurality of discharge outlets at the combustion side whereby the mixture flows out through a slotted rocket type jet. This stream is surrounded in the discharge area by a reduced pressure zone consisting of many individual air streams, the reduced pressure zone functioning like a jet pump with respect to the hot secondary air. Due to the strong aspirator effect, hot secondary air is drawn into the interstices between the individual air streams and is brought into intimate admixture with the primary stream.

In another embodiment of the present invention, both the flow cross section of the tubular conduit as well as a tube surrounding the tubular conduit contain a plurality of discharge outlets at the combustion chamber side to achieve optimum intermixture conditions.

In a further embodiment of the invention, the peripheral area of the discharge outlets is at least partially limited by means of flow diverters or similar inserts disposed within the tubular conduit. By means of such inserts, the flow cross section of the tubular conduit is divided into at least two and preferably four partial cross sections. The inclusion of such flow diverters or other inserts represents a very simple, structural feature which achieves a subdivision of the mixed stream emerging from the burner. The width of the flow diverting means is adjusted so that the reduction in cross section area increases the velocity in the discharge area substantially.

In a further embodiment of the invention, the tubular conduit coaxially surrounds at least one centrally disposed conduit. The central conduit can serve, for example, for incorporation of a further burner system such as an oil or gas burner. A pilot burner can also be placed in this inside conduit. The central conduit can also serve for the introduction of swirling air into the combustion chamber in order to influence the resulting flame shape. We can also use a plurality of such centrally disposed conduits so that an oil burner can be disposed in this area, and high velocity swirling air can also be introduced.

In a further embodiment of the invention, a plurality of pipes are disposed about the circumference of the annulus existing between the centrally disposed conduits and the tubular conduits, the plurality of pipes being parallel to the axis of the tubular conduit. Air at high velocity can be conducted through the pipes so that a strong suction effect occurs in the discharge area of the burner. This suction effect is related to the number of pipes which are disposed in the annular cross section between the two conduits. By cooperating with the reduced cross section occurring by virtue of the flow diverting means, there results an increased degree of turbulence of the stream resulting in an optimum intermixture of hot secondary air and the primary air-fuel mixture at the discharge area of the burner.

Finally, the discharge openings can be equipped with mutually independent devices for flow control. This not only provides the possibility of influencing the number of discharge openings but also the respective rates of flow so that the adjustability of the flame shape can be further improved. Such flow control devices can be designed as axially displaceable valve bodies which, according to their position, release or close a cross section of flow which is rendered either larger or smaller.

BRIEF DESCRIPTION OF THE DRAWINGS

Further advantages and features of the present invention will be apparent from the description of following illustrative embodiments schematically illustrated in the drawings.

DESCRIPTION OF THE PREFERRED EMBODIMENTS

Figure 1:
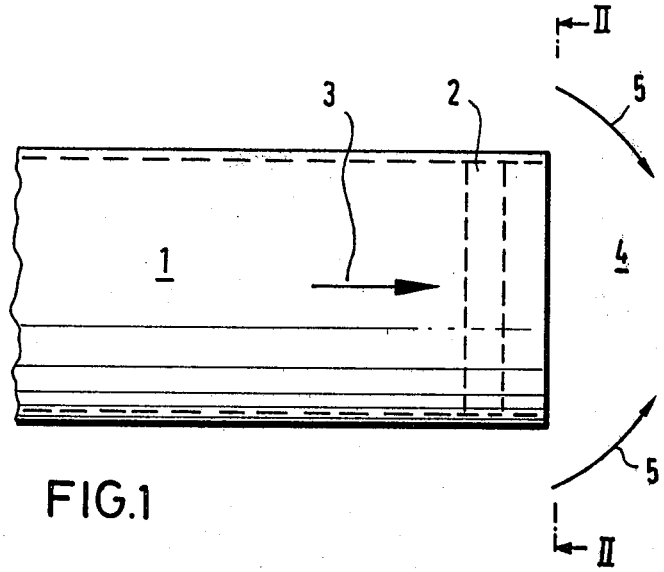
FIG. 1 is a side elevational view of one type of burner assembly which can be used.
Figure 2:
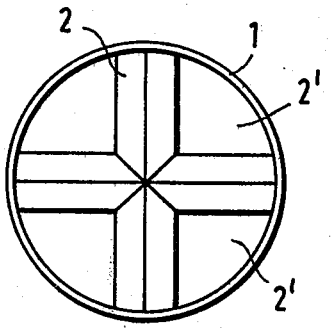
FIG. 2 is a view taken substantially along the line II—II of FIG. 1.

In FIGS. 1 and 2, reference numeral 1 indicates a tubular conduit for the introduction of solid fuels. Reference numeral 2 has been applied to flow diverters in the discharge area of the burner. These flow diverters 2 divide the flow cross section of the tubular conduit 1 into four discharge openings 2', as can be seen more specifically in FIG. 2.

The fuel conveyed by means of a primary air stream flows in the direction of arrow 3 and is divided into four partial streams in accordance with the number and disposition of the flow diverting means 2. In so doing, a reduced pressure arises in the discharge area 4 so that hot secondary air is aspirated into the primary air stream, as indicated by the arrows 5, and undergoes an intimate admixture with the exiting stream.

Figure 3:
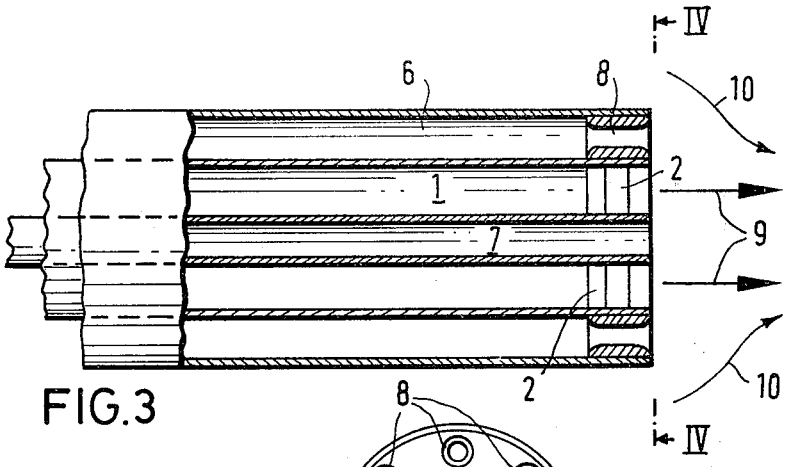
FIG. 3 is a side elevational view, partly broken away, to illustrate the interior construction of another form of the invention.
Figure 4:
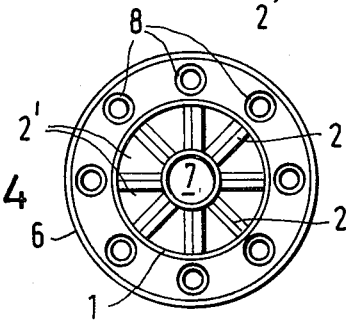
FIG. 4 is a view taken substantially along the line IV—IV of FIG. 3.

In the form of the invention shown in FIGS. 3 and 4, a tubular conduit 1 is surrounded by an outer conduit 6, and itself surrounds a coaxially disposed inner conduit 7. The outer conduit 6 is fitted with discharge orifices 8 which are designed as converging-diverging nozzles such as de Laval nozzles with an axial flow direction, to serve for conveying the air. The centrally disposed conduit 7 can serve to accommodate a pilot burner or for the introduction of further fuel, for example, in liquid or gaseous form. The fuel-primary air mixture exiting in the direction of the arrows 9 experiences an optimum intermixture with the hot secondary air drawn in the direction of the arrows 10 due to the aspiration resulting from the air stream rushing out of the de Laval nozzles. The positioning of a number of the discharge orifices 8 as well as the flow diverting means 2 can best be seen in FIG. 4.

Figure 5:
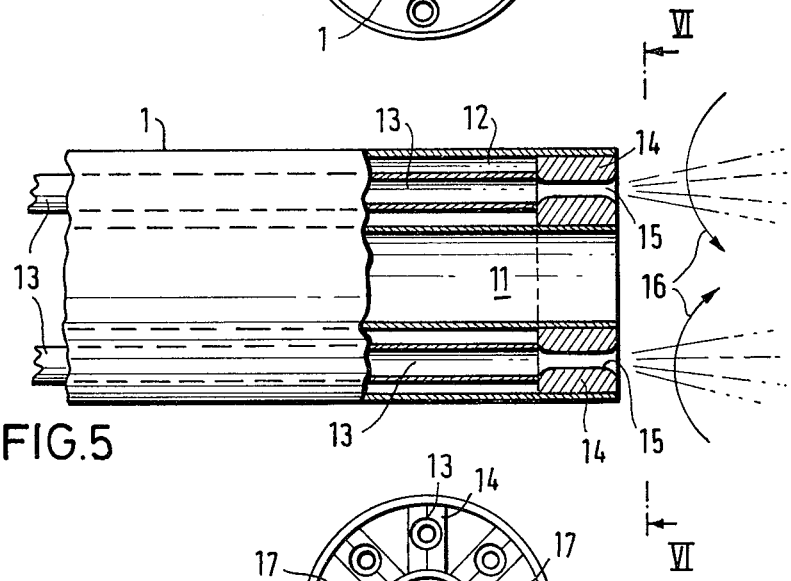
FIG. 5 is a fragmentary cross-sectional view of a still further embodiment of the invention.
Figure 6:
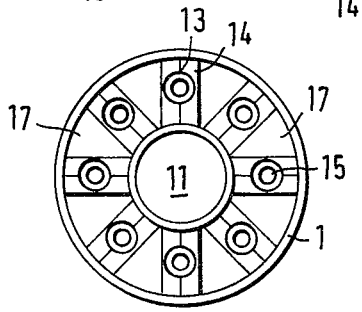
FIG. 6 is a view taken substantially along the line VI—VI of FIG. 5.

In FIGS. 5 and 6 there is shown an embodiment of a burner in which a tubular conduit 1 coaxially surrounds a centrally disposed conduit 11. A further series of pipes 13 are situated within an annular space 12 defined by the outer wall of the centrally disposed conduit 11 and the inside wall of the tubular conduit 1. The pipes 13 are uniformly distributed over the circumference of the annular space 12 and extend axially with respect to the tubular conduit 1. The pipes 13 are supported by flow diverting means 14 at their end areas facing the combustion chamber and are provided with discharge orifices 15 which provide de Laval type nozzles having an axial flow direction.

In this embodiment, the pipes 13 serve to convey clean air which emerges from the de Laval nozzles 15 with a high velocity. The reduced pressure thus produced creates an intake of hot secondary air as shown by arrows 16 directly in the area of the fuel-air mixture exiting through the discharge openings 17 defined by the interstices between the flow diverters 14. There results an intimate intermixture of the mixture with secondary air so that suitable conditions for rapid combustion are provided. In this embodiment, the centrally disposed conduit 11 can provide for additional burner systems for other fuels which are additionally employed or it can serve for locating a pilot burner.

Figure 7:
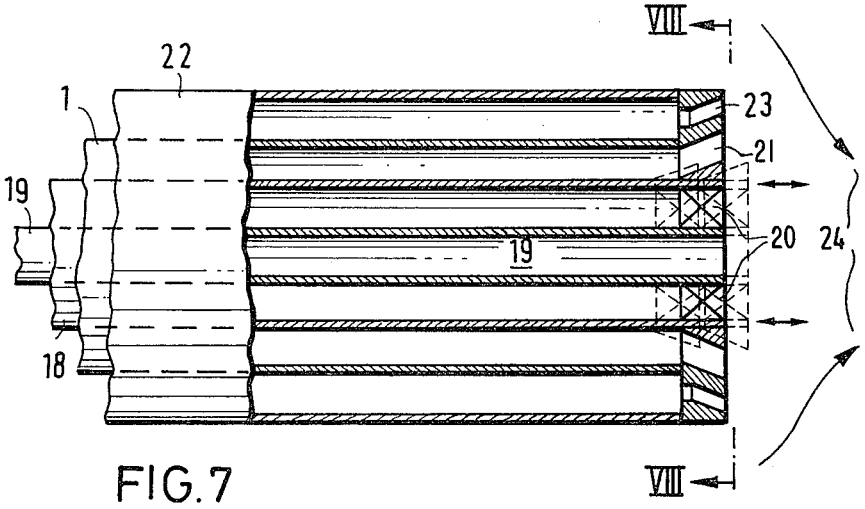
FIG. 7 is a view partly in elevation and partly in cross section illustrating a further modified form of the invention.
Figure 8:
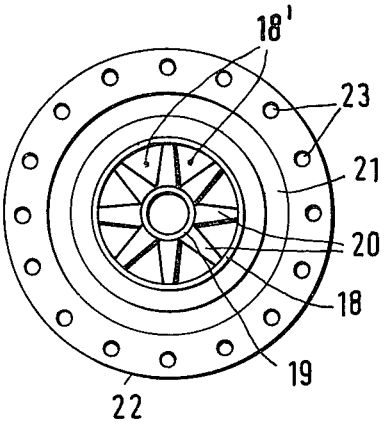
FIG. 8 is a view taken substantially along the line VIII—VIII of FIG. 7.

FIGS. 7 and 8 refer to an embodiment of a burner in which an intermediate pipe 18 together with a centrally located conduit 19 are disposed inside one another and are coaxially aligned with a tubular conduit 1. The centrally disposed conduit 19 can be used to provide a burner for burning gaseous or liquid fuels. Swirl generating inserts 20 which are known per se are disposed in the end area of the intermediate pipe 18 facing the combustion chamber. These inserts are disposed between the innner wall of the intermediate pipe 18 and the outside wall of the centrally disposed conduit 19, the inserts being schematically illustrated in the drawings and providing a plurality of discharge openings 18' between the outside wall of the centrally located conduit 19 and the inside wall of the intermediate pipe. Tubular conduit 1 is fitted with a ring which provides an annular gap type discharge opening 21 with a flow direction which diverges slightly in relation to the longitudinal axis of the tubular conduit 1. The ring 21 is surrounded by a tube 22 which has a plurality of discharge openings 23 best seen in FIG. 8. The flow direction of the discharge openings 23 likewise diverges slightly, up to an angle of about 20° and preferably by less than an angle of 15°, with respect to the longitudinal axis of the tubular guide conduit 1.

With this embodiment, a simple rate control of the mixture emerging from the annular gap type discharge opening 21 can be achieved in that the intermediate pipe 18 is disposed so as to be displaceable in the direction of the longitudinal axis of the tubular conduit 1. Air is conveyed through the intermediate pipe 18 and through the jacket tube 22, the amounts of air being variable in order to influence the resulting flame shape in the rotary tubular kiln and, ultimately, the pyrometrical process. The high velocity of the air emerging from the discharge openings 23 which act as nozzles create an intake of hot secondary air as shown by arrows 24 so that intimate intermixture of the fuel and air mixture emerging from the annular gap type discharge opening 21 is achieved with the secondary air. Consequently, a rapid combustion is achieved.

For the purpose of further improving the mixture and the aspiration with respect to the secondary air, the flow path for the fuel-air mixture can be subdivided into additional cross sections by means of flow diverting means or in some other manner instead of the annular gap type discharge opening 21.

The tubular conduit 1, and the jacket tube 22, can also be surrounded by further pipes which either coaxially surround the jacket pipe or are disposed parallel to its axis, such further pipes not having been illustrated for reasons of clarity. By means of such additional tubes, for example, an additional fuel can be introduced into the combustion chamber so that a multi-fuel burner is provided. These pipes in addition can also advantageously serve for carrying a cooling agent.

It should be evident that various modifications can be made to the described embodiments without departing from the scope of the present invention.

We claim as our invention:

1. A burner for introducing a suspension of solid fuel particles into a combustion chamber which comprises:

a centrally disposed conduit, an intermediate pipe surrounding said centrally disposed conduit and concentric therewith, a plurality of swirl generating inserts disposed at the forward end of said burner between the inner wall of said intermediate pipe and the outer wall of said centrally disposed conduit, the spaces between said inserts providing a plurality of discharge openings between the outer wall of said centrally disposed conduit and the inside wall of said intermediate pipe, a tubular conduit concentric with both said centrally disposed conduit and said intermediate pipe and surrounding the same, a ring disposed at the forward end of said tubular conduit having an annular gap therein, and an outer tube concentric with said centrally disposed conduit, said intermediate pipe and said tubular conduit, said outer tube having a plurality of spaced discharge openings thereabout circumscribing said ring, said intermediate pipe being displaceable longitudinally along the axis of said outer tube to vary the discharge through said annular gap.

2. A burner according to claim 1 in which both said annular gap and said spaced discharge openings are slightly divergent from the longitudinal axis of said outer tube.

* * * * *